United States Patent [19]

Wegrzyn

[11] 4,148,202

[45] Apr. 10, 1979

[54] DETECTOR LOCK ASSEMBLY

[76] Inventor: Lucian Wegrzyn, 72 Semel Ave., Garfield, N.J. 07026

[21] Appl. No.: 875,143

[22] Filed: Feb. 6, 1978

[51] Int. Cl.[2] ..... E05B 17/00

[52] U.S. Cl. ..... 70/431; 70/441; 70/DIG. 49

[58] Field of Search ..... 70/364 A, 376, 377, 70/378, 431, 432, 441, DIG. 49; 200/61.66; 340/276

[56] References Cited

U.S. PATENT DOCUMENTS

| | | | |
|---|---|---|---|
| 3,971,009 | 7/1976 | Fujiwara | 340/27 C |
| 3,986,376 | 10/1976 | Lack | 70/364 A |

*Primary Examiner*—Robert L. Wolfe
*Attorney, Agent, or Firm*—Leonard W. Suroff

[57] ABSTRACT

A detector lock assembly comprising a cylinder body having a spaced apart front and rear end with a bore therein extending along an axis and a plug rotatable in the bore on the axis with means defining a keyway in the plug and adapted to receive therein a key of a defined length and configuration to permit rotation of the plug relative to said cylinder body. Detection means is operatively associated with the cylinder body at the rear end thereof so as to establish an electrical circuit when a key or other object is inserted within the keyway that has a length that is less or greater than the defined length for the key.

9 Claims, 5 Drawing Figures

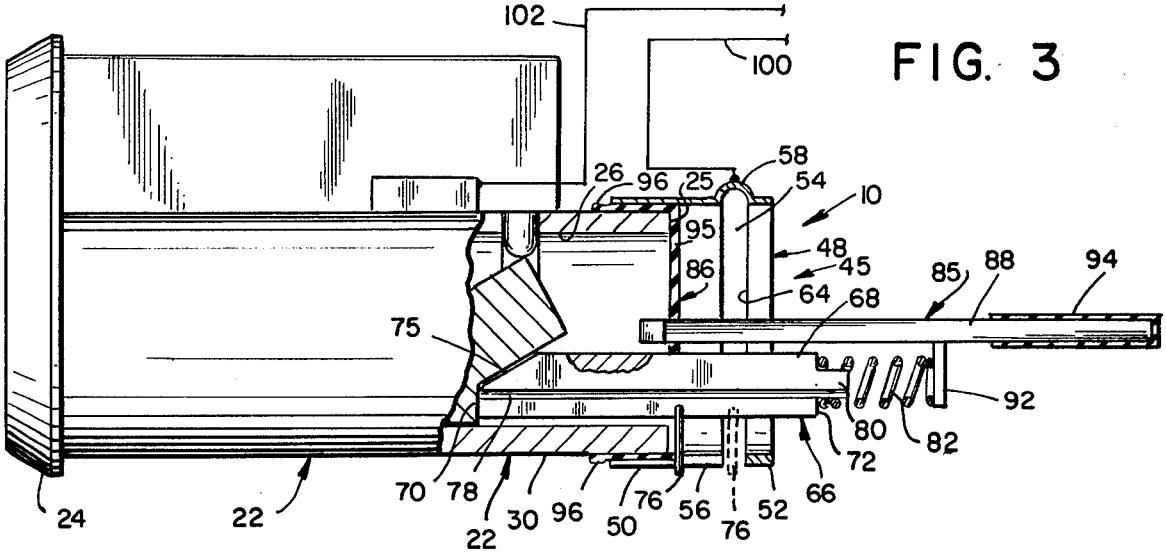
FIG. 3
FIG. 4
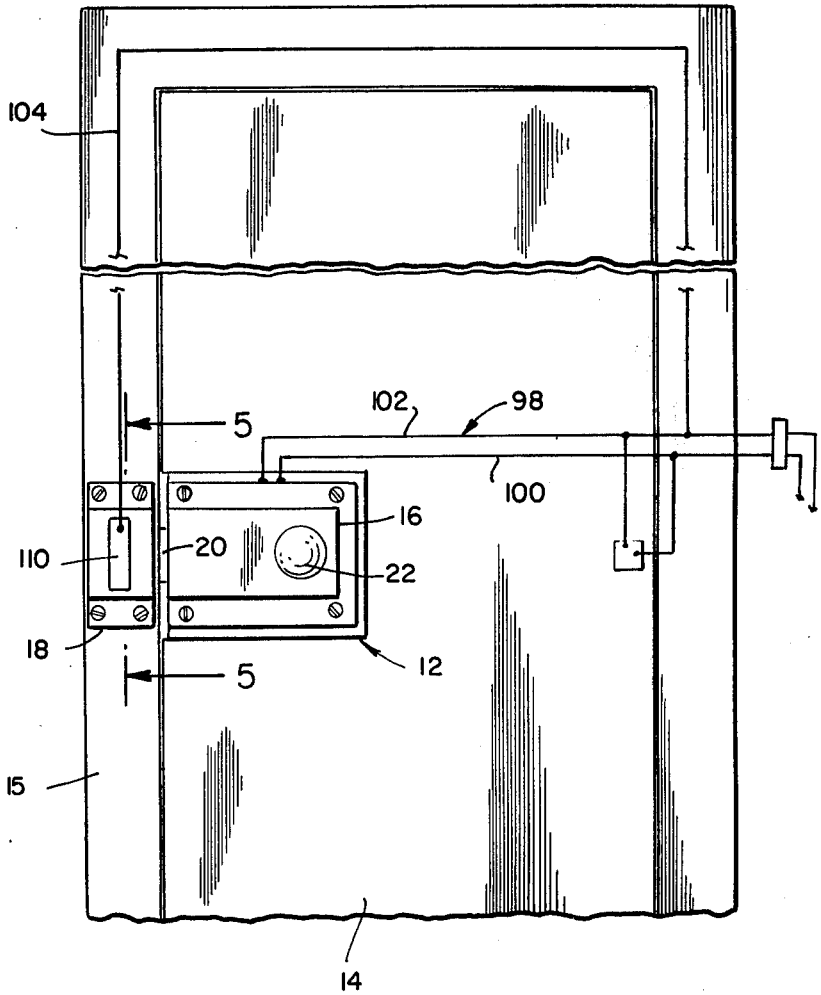
FIG. 5
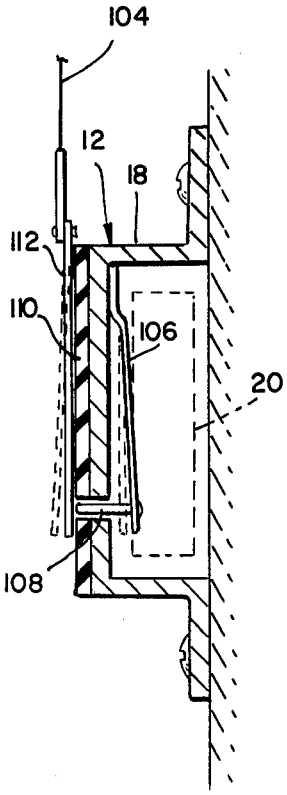

DETECTOR LOCK ASSEMBLY

BACKGROUND OF THE INVENTION

1. Field of the Invention

The present invention pertains to locks that are designed to provide an alarm when an improper key or other means such as lock picks are utilized.

In the provision of locks such as door locks for buildings and the like it is customary to have a cylinder mechanism including a cylinder body having a plug rotatable therein. The plug has a keyway into which a proper key can be introduced. The cylinder body has pin bores in it extending into the plug bore and containing first pins that are slidable in the bores and are urged toward the keyway by springs. Also there are provided pin openings in the plug communicating with the keyway and in one rotated position of the plug also communicating with the pin bores. The mechanism can readily be operated by a proper key introduced into the keyway and setting the first pins and the second pins in appropriate relationship with their abutting faces coinciding with the shear line of the plug in the cylinder body. There are instances in which the attempted operation of the lock either by an improper key or other means such as lock picks should be evidenced, by an alarm or other informational output.

2. Description of the Prior Art

Various types of alarm actuating mechanisms are disclosed in the prior art whereby unauthorized entry into a locked premises is sensed and indicated by the operation of an alarm. However, all too often mechanisms of this type have been able to be defeated so that the alarm is not actuated upon the occurrence of an unauthorized entry; and, even where the alarm is actuated, this usually occurs after the entry has taken place. As the security technology has advanced the development of means to nullify the improvements has also advanced. Thus, there has been a long standing need for a tamperproof lock mechanism which, while operable to permit authorized entry, resists unauthorized entry and may be combined with means to actuate an alarm upon attempted unauthorized entry.

The present invention contemplates a key actuated lock mechanism of the class described which is exceedingly difficult, if not impossible, to manipulate without a proper key and which may be associated with alarm actuating means so that, if even partially manipulated, it will actuate an alarm.

Locks having an alarm system associated therewith are illustrated in the prior art as set forth in U.S. Pat. Nos. 3,500,670, 3,967,481, and 3,986,376. A common aspect of each of these prior art patents is that the alarm actuating aspect is associated with the vertically disposed tumbler pins which are loaded by coil springs to prevent vertical displacement unless the proper key is inserted within the key slot. The present invention does not interrelate the movement of the tumbler pins to actuation of the alarm system associated with the invention.

OBJECTS OF THE INVENTION

An object of the present invention is to provide a lock assembly or mechanism which will afford a prompt alarm when an attempt is made to operate the pin mechanism in the cylinder body with an improper key.

Another object of the present invention is to provide a lock having an alarm system associated therewith and which is operated by activating means when brought into an operative condition when any foreign object beyond the length of the key is brought into the key slot.

Other objects and advantages of the present invention will become apparent as the disclosure proceeds.

SUMMARY OF THE INVENTION

A detector lock assembly comprising a cylinder body having a spaced apart front and rear end with a bore therein extending along an axis and a plug rotatable in the bore on the axis with means defining a keyway in the plug and adapted to receive therein a key of a defined length and configuration to permit rotation of the plug relative to said cylinder body. Detection means is operatively associated with the cylinder body at the rear end thereof so as to establish an electrical circuit when a key or other object is inserted within the keyway that has a length that is less or greater than the defined length for the key.

The detection means includes a detection element having a front section and a rear section in fixed spaced relation to each other with a vertical channel therebetween. The front section mounted relative to the rear end of the body and having a longitudinally extending slot therein defining a pair of first contacting surfaces that act as electrical contacts.

The rear section extends rearwardly of the body and having a second contacting surface that acts as an electrical contact. Contacting means that is slidable in the keyway in response to the length of the key inserted therein, for establishing possible electrical contact with the first contacting surfaces if the key inserted is too short or the second contacting surface if the key inserted is too long is provided. The term "key" is used to also denote foreign objects that may be used in an attempt to pick the lock, etc.

The assembly also includes stop means as well as mounting means for supporting the stop means in fixed relation to the rear end of the body. The stop means includes a stop element in axial alignment with the movement of the contacting means. A spring engages the contacting means and the stop element for urging the contacting means in its normal position for engagement with the front end of any key inserted within the keyway.

The contacting means and the body are of electrically conducting material, while the detection element and the stop means are electrically insulated from the body, and the contacting means is an electrical conductor movable into electrical conduction with the body and the detection element.

The contacting means includes an elongated body portion slidable within the keyway in response to movement of a key therein and is adapted for angular rotation with the body between open and closed positions of the lock assembly. A contacting element extends downwardly from the body portion for longitudinal displacement within the slot. The contacting element being confined within the slot if the key utilized is too short such that upon rotation of the body and the contacting means the contacting element will abut one of the first contacting surfaces and make electrical contact.

The contacting element will abut the second contacting surface if the key utilized is too long such that prior to any rotation of the body electrical contact will be made. If the proper length key is used the contacting element is displaced into and is free to be angularly rotated in the vertical channel and no electrical contact would be made. In this condition no alarm or signal would be given.

The front section forms a band having a leading edge and a rear edge, the band having a circular configuration to circumferentially enclose the body and terminating in the first contacting surfaces, and the rear section being integrally formed with the first section and the second contacting surface extending in a plane substantially normal to the axis and in substantially parallel spaced relationship to the rear edge. The contacting element includes a support member extending outwardly from the elongated body for mounting the spring coaxially therewith.

The stop means includes an elongated stop member with a head at one end thereof for abutting engagement with the mounting means, and the stop element extends outwardly from the stop member.

BRIEF DESCRIPTION OF THE DRAWINGS

Although the characteristic features of this invention will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

FIG. 3 is a view similar to FIG. 1 partially in cross section illustrating the present invention;

FIG. 4 is a front plan view of a door with the lock of the present invention associated therewith; and FIG. 5 is a sectional view taken along lines 5—5 of FIG. 4.

DETAILED DESCRIPTION OF THE DRAWINGS

Figures 1, 2:
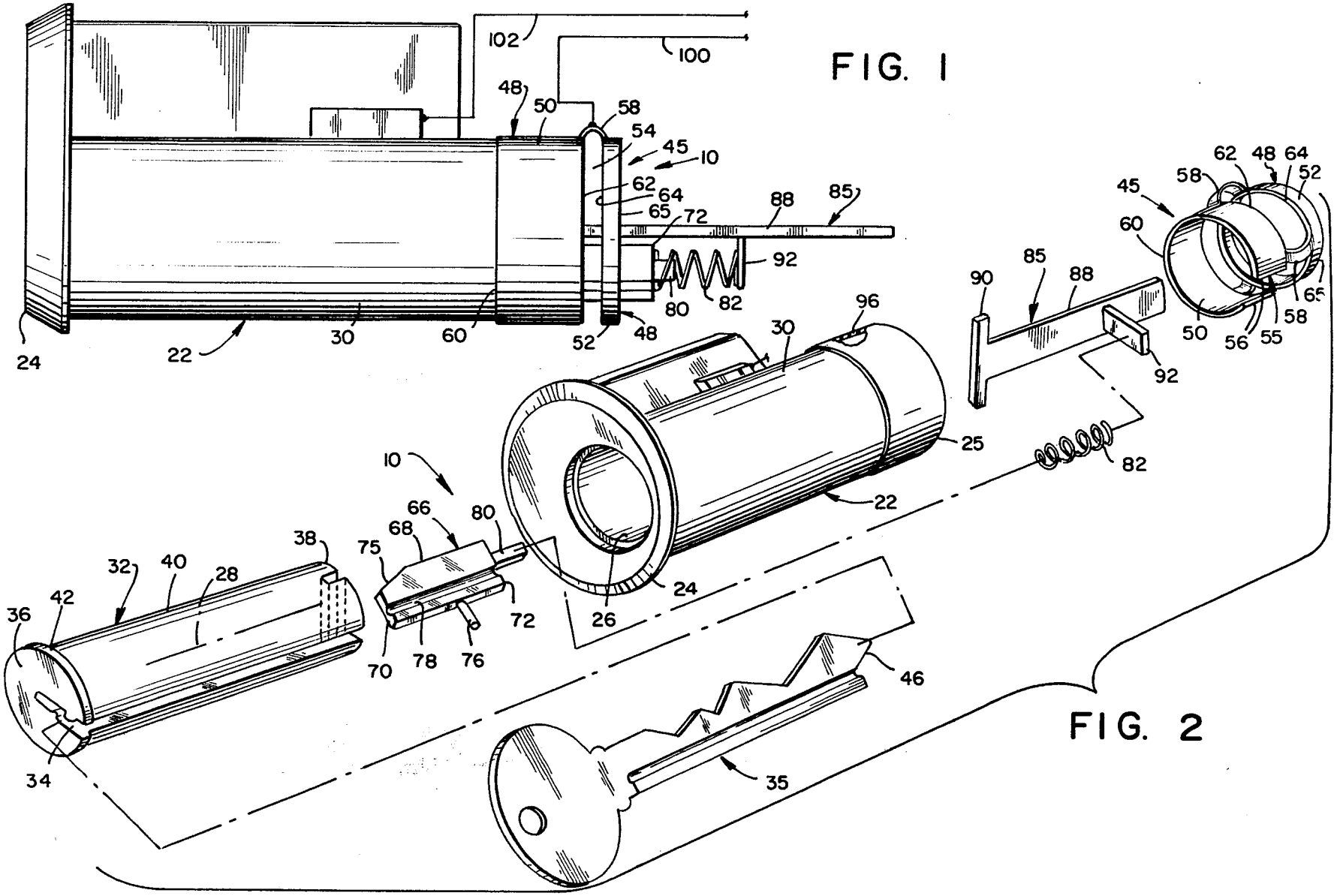
FIG. 1 is a side view of the detector lock assembly of the present invention.
FIG. 2 is an exploded view showing the component parts of the present invention.

Referring to the drawings, there is illustrated in FIGS. 1-5 a detector lock assembly 10 that is adapted to be incorporated in a lock 12 which is mounted on a door 14 and a door frame 15 in a conventional manner. The lock 12 will include a lock housing 16 and a lock receiver 18 in a conventional manner. The lock 12 illustrated in FIG. 4 being viewed from the interior of the house, apartment, etc., in which it is being used. A bolt 20 and knob 22 form part of the lock 12.

The detector lock assembly 10 includes a cylinder body 22 having a spaced apart front end 24 and rear end 25 with an axial bore 26 therein extending along an axis 28. The body 22 includes an outer surface or wall 30 that may be of a circular configuration. A plug 32 is provided and is rotatable in the bore 26 on the axis 28 with means defining a keyway 34 in the plug and adapted to receive therein a key 35 of a defined length and configuration to permit rotation of the plug 32 relative to the cylinder body 22.

The plug 32 includes a front 36 and back 38 with an outer end 40 adapted to extend in telescopic relationship within the bore 25. The plug 32 has an enlarged flange 42 at its front 36. The plug 32 may have a circular surface at its outer end 40. The keyway 34 may extend longitudinally the length of the plug 32.

Detection means 45 is operatively associated with the cylinder body 22 at the rear end 25 thereof so as to establish an electrical circuit when the key 35 or other object is inserted within the keyway 34 that has a length that is less or greater than the defined length for the key 35. The key 35 may have a distal end 46 that may be contoured to have a specific shape and length.

The detection means 45 includes a detection element 48 having a front section 50 and a rear section 52 in fixed spaced relation to each other with a vertical channel 54 therebetween. The front section 50 is mounted relative to the rear end 25 of the body 22 and having a longitudinally extending slot 55 therein defining a pair of first contacting surfaces 56 that act as electrical contacts. The front section 50 may be integrally formed with the rear section 52 and joined as by connectors 58.

The front section 50 forms a band having a leading edge 60 and a rear edge 62. The band may have a circular configuration to circumferentially enclose the body 22 at its outer surface 30 and terminating in the first contacting surfaces 56. The rear section 52 is integrally formed with the first section 50 and includes a second contacting surface 64 that extends in a plane substantially normal to the axis 28 and in substantially parallel spaced relationship to the rear edge 62.

The rear section 52 extends rearwardly of the body 22, and the second contacting surface 64 acts as an electrical contact. The rear section 52 includes a back end 65 that may extend in a plane parallel to the second contacting surface 64. Mounted to function in conjunction with the detection means 45 is contacting means 66 that is slidable in the keyway 34 in response to the length of the key 35 inserted therein, for establishing possible electrical contact with the first contacting surfaces 56 if the key 35 inserted is too short or the second contacting surface 64 if the key 35 inserted is too long.

The contacting means 66 includes an elongated body portion 68 slidable within the keyway 34 in response to movement of a key 35 therein and is adapted for angular rotation with the body 22 between open and closed positions of the lock assembly 10. The body portion 68 is of a metallic material and has spaced apart inner end 70 and outer end 72. The inner end 70 may have a tapered portion 75 that coincides with the angle at the distal end 46 of the key 35. In this manner longitudinal movement of the key 35 within the keyway 34 will effect lateral movement of the contacting means 66 in the keyway 34.

A contacting element 76 extends downwardly from the body portion 68 for longitudinal displacement within the slot 55. The contacting element 66 being confined within the slot 55 if the key 35 utilized is too short such that upon rotation of the body 22 and the contacting means 66, the contacting element 76 will abut one of the first contacting surfaces 56 and make electrical contact.

The contacting element 76 will abut the second contacting surface 64 if the key 35 utilized is too long such that prior to any rotation of the body 22 electrical contact will be made. If the proper length key 35 is used, the contacting element 76 is displaced into and is free to be angularly rotated in the vertical channel 54 and no electrical contact would be made. In this condition no alarm or signal would be given. The body portion 68 may have a groove 78 extending longitudinally therealong and adapted to mate with a portion of the keyway 34 and slide freely therein.

The contacting element 76 includes a support member 80 extending outwardly from the elongated body 66 at the outer end 72 for mounting a spring 82 coaxially therewith.

The assembly 10 also includes stop means 85 as well as mounting means 86 for supporting the stop means 85 in fixed relation to the rear end 25 of the body 22. The stop means 85 includes an elongated stop member 88 with a head 90 at one end thereof for abutting engagement with the mounting means 86 and a stop element 92 extends outwardly from the stop member 88. An insulation 94 may be provided at the back of the stop member 88.

The mounting means 86 may be in the form of an insulative plate 95 that extends across the body 22 at the end 25 with an opening therein to receive the stop member 88 therethrough. As illustrated in FIG. 3, the spring 82 provides the necessary force to retain the body portion 68 in its normally operative position, yet permitting longitudinal displacement when the key 35 is inserted in the keyway 34.

The stop element 92 is in axial alignment with the movement of the contacting means 66. The spring 82 engages the contacting means 66 and the stop element 92 for urging the contacting means 66 in its normal position for engagement with the front end 46 of any key 35 inserted within the keyway 34 that is provided.

The contacting means 66 and the body 22 are of electrically conducting material such as metal, while the detection element 48 and the stop means 85 are electrically insulated from the body 22. The contacting means 66 is an electrical conductor movable into electrical conduction with the body 22 and the detection element 48.

As illustrated in FIG. 3, an insulative sleeve 96 is contained between the outer surface 30 of body 22 and the inside of the front section 50 of the detection element 48. By this arrangement the contacting element 76 will complete the electrical circuit if it engages either the first contacting surfaces 56 or second contacting surface 64. The contacting element 76 is illustrated by broken lines in FIG. 3, which is the proper position when the proper key 35 is utilized. In this position the contacting element 76 will rotate freely within the channel 54 which is of greater dimension or width than the element 76.

The electrical circuit 98 for providing an audible or visual signal when the electrical circuit is complete may be of a design known in the art. Leads 100 and 102 are connected to the detection means 45 and the body 22, respectively. When contact is made between the contacting element 76 and any of the contacting surfaces 56 and 64, the circuit is completed and an alarm may be sounded.

The alarm may be battery powered or wired to a source of electrical current in a conventional manner. If no contact is made, the lock 12 will function in its intended manner and the lock will be opened or closed. It is appreciated that any rearward movement of the body portion 68, by a key or other instrument, beyond a certain distance will set off the alarm.

As illustrated in FIGS. 4 and 5, the lock 12 may further include in conjunction with the lock receiver 18 a secondary alarm circuit that includes lead 104. A hinge element 106 is contained within the lock housing 18 and is mounted for pivotal movement with a pin 108 extending through the lock housing 16.

When the hinge element 106 is depressed, it will make contact with the bolt 20. A cover 110 of insulative material is situated over the lock receiver 18 and a contact arm 112 is adapted to be brought into the position illustrated in FIG. 5. The arm 112 engages the pin 108 to provide electrical contact with the bolt 20. Lead 104 is connected to the electrical circuit 98 and arm 112. The wiring of the electrical circuit 98 may be such that if the contact between the bolt 20 and the arm 112 is broken the circuit 98 will be opened and the alarm set off.

In this manner if unauthorized entry into the dwelling is attempted and the bolt 20 is retracted from its position within the lock receiver 18, the circuit 98 will be opened. The additional feature may be used if desired; if not desired the arm 112 may be disengaged by swinging it out of overlapping engagement with pin 108, and then the detector lock assembly 10, as illustrated in FIGS. 1–4, will function independently of the additional features illustrated in FIGS. 4 and 5.

Although an illustrative embodiment of the invention has been described in detail herein with reference to the accompanying drawings, it is to be understood that the invention is not limited to the precise embodiment, and that various changes and modifications may be effected therein without departing from the scope or spirit of the invention.

I claim:

1. A detector lock assembly comprising:

A. a cylinder body having a spaced apart front and rear end with a bore therein extending along an axis, B. a plug rotatable in said bore on said axis, C. means defining a keyway in said plug and adapted to receive therein a key of a defined length and configuration to permit rotation of said plug relative to said cylinder body, D. detection means operatively associated with said cylinder body at said rear end thereof so as to establish an electrical circuit when a key or the like is inserted within said keyway that has a length that is less or greater than said defined length for the key, and E. said detection means includes:

(1) a detection element having a front section and a rear section in fixed spaced relation to each other with a vertical channel therebetween, (2) said front section mounted relative to said rear end of said body and having a longitudinally extending slot therein defining a pair of first contacting surfaces, (3) said rear section extending rearwardly of said body and having a second contacting surface, and (4) contacting means slidable in said keyway in response to the length of the key inserted therein for establishing possible electrical contact with said first contacting surfaces if the key inserted is too short or said second contacting surface if the key inserted is too long.

2. An assembly as defined in claim 1, including a. stop means, b. mounting means for supporting said stop means in fixed relation to said rear end of said body, c. said stop means including a stop element in axial alignment with the movement of said contacting means, and d. a spring engaging said contacting means and said stop element for urging said contacting means in its normal position for engagement with the front end of any key inserted within said keyway.

3. An assembly as defined in claim 2, wherein said contacting means and said body are of electrically conducting material, said detection element and said stop means are electrically insulated from said body, and said contacting means is an electrical conductor movable into electrical conduction with said body and said detection element.

4. An assembly as defined in claim 1, wherein said contacting means includes:

a. an elongated body portion slidable within said keyway in response to movement of a key therein, and adapted for angular rotation with said body between open and closed positions of said lock assembly, b. a contacting element extending downwardly from said body portion for longitudinal displacement within said slot, said contacting element being confined within said slot if the key utilized is to short such that upon rotation of said body and said contacting means said contacting element will abut one of said first contacting surfaces and make electrical contact, c. said contacting element will abut said second contacting surface if the key utilized is to long such that prior to any rotation of said body electrical contact will be made, and d. said contacting element is displaced into and is free to be angularly rotated in said vertical channel when a key of proper length is inserted in said keyway.

5. An assembly as defined in claim 4, wherein a. said front section forms a band having a leading edge and a rear edge, said band having a circular configuration to circumferentially enclose said body and terminating in said first contacting surfaces, and b. said rear section being integrally formed with said first section and said second contacting surface extending in a plane substantially normal to said axis and in substantially parallel spaced relationship to said rear edge.

6. An assembly as defined in claim 5, wherein said rear section forms a circular band.

7. An assembly as defined in claim 4, wherein said contacting element includes a support member extending outwardly from said elongated body for mounting said spring coaxially therewith.

8. An assembly as defined in claim 4, wherein said contacting element has longitudinal clearance within said vertical channel so as to permit for angular displacement therein.

9. An assembly as defined in claim 4, wherein a. said stop means includes an elongated stop member with a head at one end thereof for abutting engagement with said mounting means, and b. said stop element extends outwardly from said stop member.

* * * * *